US007634999B2

(12) United States Patent
Lewis

(10) Patent No.: US 7,634,999 B2
(45) Date of Patent: Dec. 22, 2009

(54) HYPERBARIC CHAMBER

(75) Inventor: Peter A. Lewis, Scotia, NY (US)

(73) Assignee: Hyperbaric Technologies, Inc., Amsterdam, NY (US)

( * ) Notice: Subject to any disclaimer, the term of this patent is extended or adjusted under 35 U.S.C. 154(b) by 53 days.

(21) Appl. No.: 11/481,899

(22) Filed: Jul. 7, 2006

(65) Prior Publication Data

US 2008/0006272 A1 Jan. 10, 2008

(51) Int. Cl.
*A61G 10/00* (2006.01)

(52) U.S. Cl. ..... 128/202.12; 128/205.26; 128/202.13

(58) Field of Classification Search ..... 128/205.26, 128/202.12, 202.13
See application file for complete search history.

(56) References Cited

U.S. PATENT DOCUMENTS

| | | | | |
|---|---|---|---|---|
| 1,294,188 | A | 2/1919 | Stelzner | |
| 2,401,230 | A | 5/1946 | Colley | 128/298 |
| 2,731,055 | A | 1/1956 | Smith | 150/52 |
| 3,387,412 | A | 6/1968 | Kwake | 52/2 |
| 3,602,221 | A | 8/1971 | Bleicken | 128/204 |
| 3,729,002 | A | 4/1973 | Miller | 128/204 |
| 3,768,467 | A | 10/1973 | Jennings | 128/145 R |
| 3,801,093 | A | 4/1974 | Jones | 272/3 |
| 4,103,369 | A | 8/1978 | Riordan | 4/172.12 |
| 4,106,504 | A | 8/1978 | York | 128/204 |
| 4,196,656 | A | 4/1980 | Wallace et al. | 98/1.5 |
| 4,294,242 | A | 10/1981 | Cowans | 128/201.13 |
| 4,432,354 | A * | 2/1984 | Lasley | 601/43 |
| 4,509,513 | A | 4/1985 | Lasley | 128/202.12 |
| 4,567,696 | A | 2/1986 | Malet | 52/2 |
| 4,691,695 | A | 9/1987 | Birk | |
| 4,736,762 | A * | 4/1988 | Wayman | 52/2.14 |
| 4,974,829 | A | 12/1990 | Gamow et al. | 272/3 |
| 5,398,678 | A | 3/1995 | Gamow | 128/205.26 |

(Continued)

FOREIGN PATENT DOCUMENTS

| | | | |
|---|---|---|---|
| DE | 3004-156 | A1 | 5/1980 |
| WO | 2008010914 | A2 | 1/2008 |

OTHER PUBLICATIONS

Operating and Reference Manual "Portable Mild Hyperbaric Chambers", Oxy Health Corporation, 2002.

(Continued)

*Primary Examiner*—Patricia M Bianco
*Assistant Examiner*—Nihir Patel
(74) *Attorney, Agent, or Firm*—Wiley Rein LLP

(57) ABSTRACT

A hyperbaric chamber includes a collapsible, pressurizable bladder and an inflatable support member supporting the bladder in a substantially uncollapsed configuration. The inflatable support member may be either internal or external to the bladder, and, in embodiments, is a rib with curvature corresponding generally to the uncollapsed shape of the bladder. A stiffening stave may provide additional support. The bladder further includes an accessway into the interior thereof and a substantially non-breathable closure on the accessway. The closure includes a substantially air-impermeable gasket sandwiched between first and second zippers. A reinforcing zipper may provide additional strength to the closure. Similarly, a reinforcing harness substantially surrounding the bladder may provide additional strength to the bladder. A source of compressed air is in fluid communication with the interior of the bladder, and a cooling source may also be provided.

17 Claims, 6 Drawing Sheets

U.S. PATENT DOCUMENTS

| | | | | |
|---|---|---|---|---|
| 5,402,775 | A | 4/1995 | Reneau | |
| 5,678,543 | A * | 10/1997 | Bower | 128/205.26 |
| 5,964,222 | A * | 10/1999 | Kotliar | 128/205.26 |
| 6,241,653 | B1 * | 6/2001 | Gauger et al. | 600/21 |
| 6,321,746 | B1 * | 11/2001 | Schneider et al. | 128/202.12 |
| 6,748,760 | B1 * | 6/2004 | Cheng | 62/408 |

OTHER PUBLICATIONS

International Search Report and Written Opinion of International Searching Authority in PCT/US07/15406 dated Jun. 4, 2008.

International Search Report and Written Opinion of the International Searching Authority for PCT/US08/85404, Mailed Feb. 4, 2009.

* cited by examiner

HYPERBARIC CHAMBER

FIELD OF THE INVENTION

The present invention relates generally to hyperbaric chambers. More particularly, the present invention relates to a collapsible, high-pressure (i.e., on the order of about 22 psig) hyperbaric chamber with an inflatable support structure.

BACKGROUND OF THE INVENTION

Certain activities, such as mountaineering and skiing, subject participants to reduced pressures. These reduced pressures can lead to what is commonly referred to as mountain sickness, with symptoms including nausea and headache. Other activities, such as diving and deep sea construction, subject participants to elevated pressures. If the participant returns to normal atmospheric pressures too rapidly, the participant may experience the detrimental health effects of decompression sickness.

To treat either mountain sickness or decompression sickness, it is known to place the patient in a high-pressure environment. Hyperbaric chambers are a convenient way to provide such a therapeutic environment. A hyperbaric chamber is a chamber in which a pressure greater than ambient, over and above the range of pressure variation encountered in the course of normal weather fluctuations, can be achieved. U.S. Pat. No. 4,974,829 to Gamow et al. ("Gamow") and U.S. Pat. No. 5,678,543 to Bower ("Bower"), the disclosures of which are hereby expressly incorporated by reference in their entireties, provide examples of such hyperbaric chambers.

Extant hyperbaric chambers, however, generally require a tradeoff between portability and capacity. That is, higher-pressure hyperbaric chambers tend to be more rigid and less portable, while portable chambers tend to be lower pressure. The hyperbaric chamber of Gamow, for example, is a portable chamber capable of achieving pressures up to about 10 psig, which are suitable for treating mild symptoms of pressure sickness. As one of skill in the art will recognize, higher pressure chambers are useful for treating more severe symptoms of decompression or mountain sickness, as well as for other conditions including carbon monoxide poisoning, wound healing, and burns.

Further, to the extent that a portable chamber is also collapsible, a rigid frame, generally made of metal, is often used to retain the uncompressed chamber in a substantially uncollapsed configuration. This aids in ingress to and egress from the chamber when it is in an unpressurized state (i.e., before or after treatment). Installation of this rigid frame into the chamber may be difficult and time consuming. In addition, an exposed metal frame within the chamber is not aesthetically pleasing and may also be physically uncomfortable for the chamber occupant.

Accordingly, it is desirable to provide a portable hyperbaric chamber that retains a substantially uncompressed shape without the need for a rigid frame. It is further desirable for the portable hyperbaric chamber to be capable of operating at higher pressures, on the order of up to about 22 psig. It is further desirable for the portable hyperbaric chamber to be capable of sustaining still higher pressures so as to provide an operating safety factor and to reduce the likelihood of sudden decompression.

SUMMARY OF THE INVENTION

The foregoing needs are met, to a great extent, by the present invention, wherein in one aspect an apparatus is provided that in some embodiments is a portable, high-pressure capable, hyperbaric chamber. The chamber is collapsible and includes an inflatable support structure that substantially reduces the need for and alleviates the disadvantages of a rigid frame. The instant hyperbaric chamber further incorporates reinforcements that permit operation at and achievement of higher pressures, up to about 22 psig, with a substantially reduced likelihood of sudden decompression.

In accordance with one embodiment of the present invention, a hyperbaric chamber includes a collapsible, pressurizable bladder and an inflatable support member supporting the bladder in a substantially uncollapsed configuration. The inflatable support member may be an internal or external inflatable rib. The bladder includes an accessway into an interior thereof, and the accessway may be closed by a substantially non-breathable closure. The non-breathable closure includes first and second zippers and a substantially air-impermeable gasket disposed therebetween. Various reinforcing features, such as a reinforcing zipper on the closure, a reinforcing harness, and a polycarbonate-reinforced viewport, may be incorporated to permit the chamber to achieve higher pressures.

In accordance with another embodiment of the present invention, a system for treating pressure sickness symptoms is provided. The system includes a collapsible chamber capable of sustaining hyperbaric pressures, a reinforcing harness substantially surrounding the chamber, and a source of compressed air in fluid communication with the interior of the chamber. An accessway, closable by a substantially non-breathable closure, provides access to the interior of the chamber. The reinforcing harness is disposed on an outer surface of the chamber and includes a plurality of hoop straps substantially surrounding the chamber and interconnected by at least one longitudinal reinforcing strap.

According to yet another embodiment of the present invention, a hyperbaric chamber includes a collapsible, pressurizable bladder including an accessway into an interior thereof, a substantially non-breathable closure on the accessway, and a reinforcing zipper disposed on one side of the closure. The non-breathable closure includes a substantially air-impermeable gasket sandwiched between first and second zippers. The reinforcing zipper permits the bladder to attain and contain higher hyperbaric pressures.

There have thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
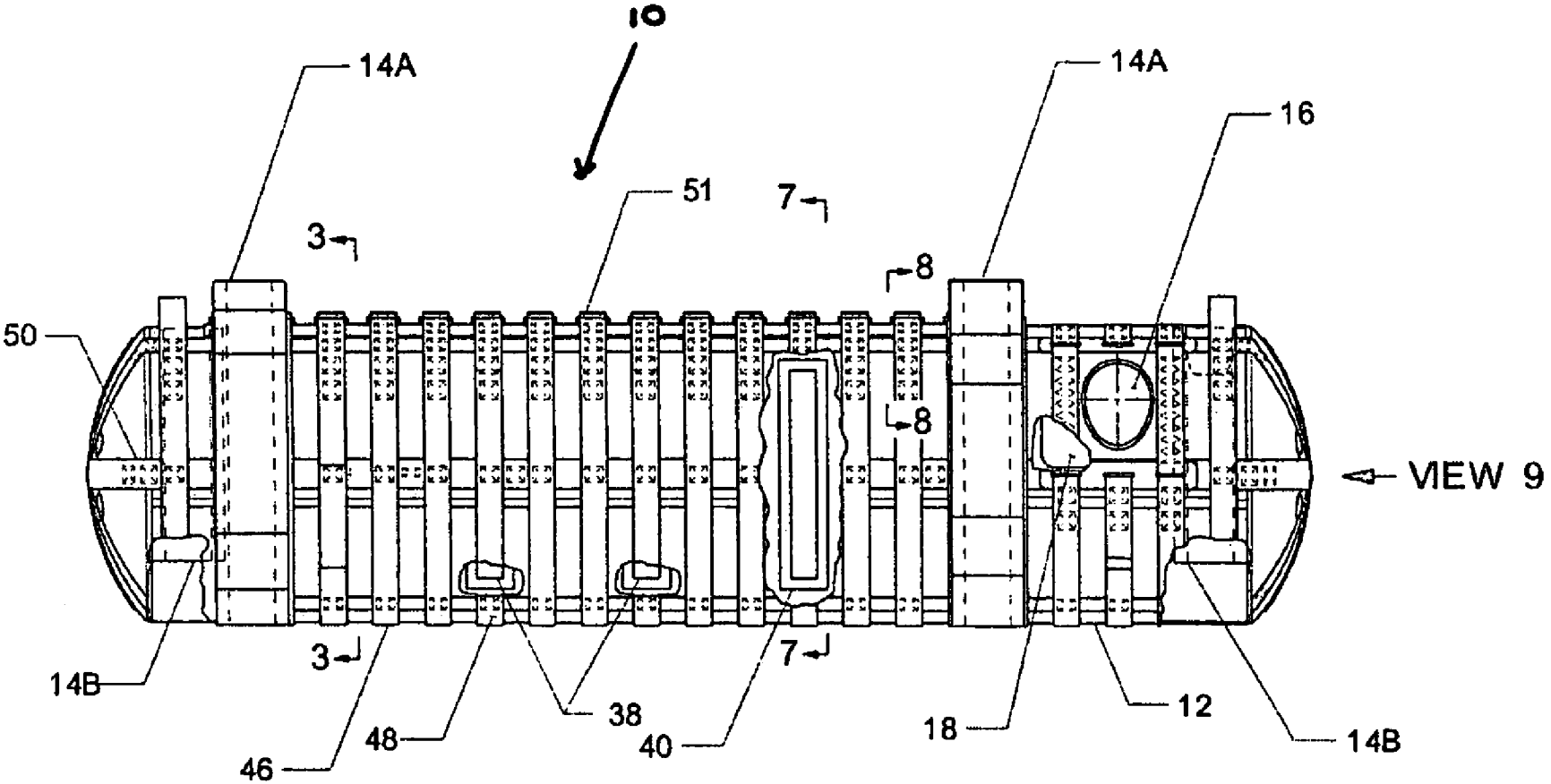
FIG. 1 is a partially broken away front view of a hyperbaric chamber according to an embodiment of the present invention.

The invention will now be described with reference to the drawing figures, in which like reference numerals refer to like parts throughout. An embodiment in accordance with the present invention provides a collapsible, pressurizable bladder and an inflatable support member supporting the bladder in a substantially uncollapsed configuration. The use of an inflatable support member facilitates rapid and simple installation of the support structure as compared to a rigid frame. Further, whereas a rigid frame is not aesthetically pleasing and is potentially physically uncomfortable, an inflatable support member is both attractive and more comfortable for the occupant of the chamber.

A system for treating symptoms of pressure sickness includes a collapsible chamber capable of sustaining hyperbaric pressures. A reinforcing harness is disposed on an outer surface of the chamber. The reinforcing harness permits the chamber to both operate at and sustain higher pressures than extant flexible, collapsible hyperbaric chambers. Thus, the instant invention can be used to create a therapeutic environment for treating both more severe pressure sickness symptoms and other undesirable conditions.

Figure 2:
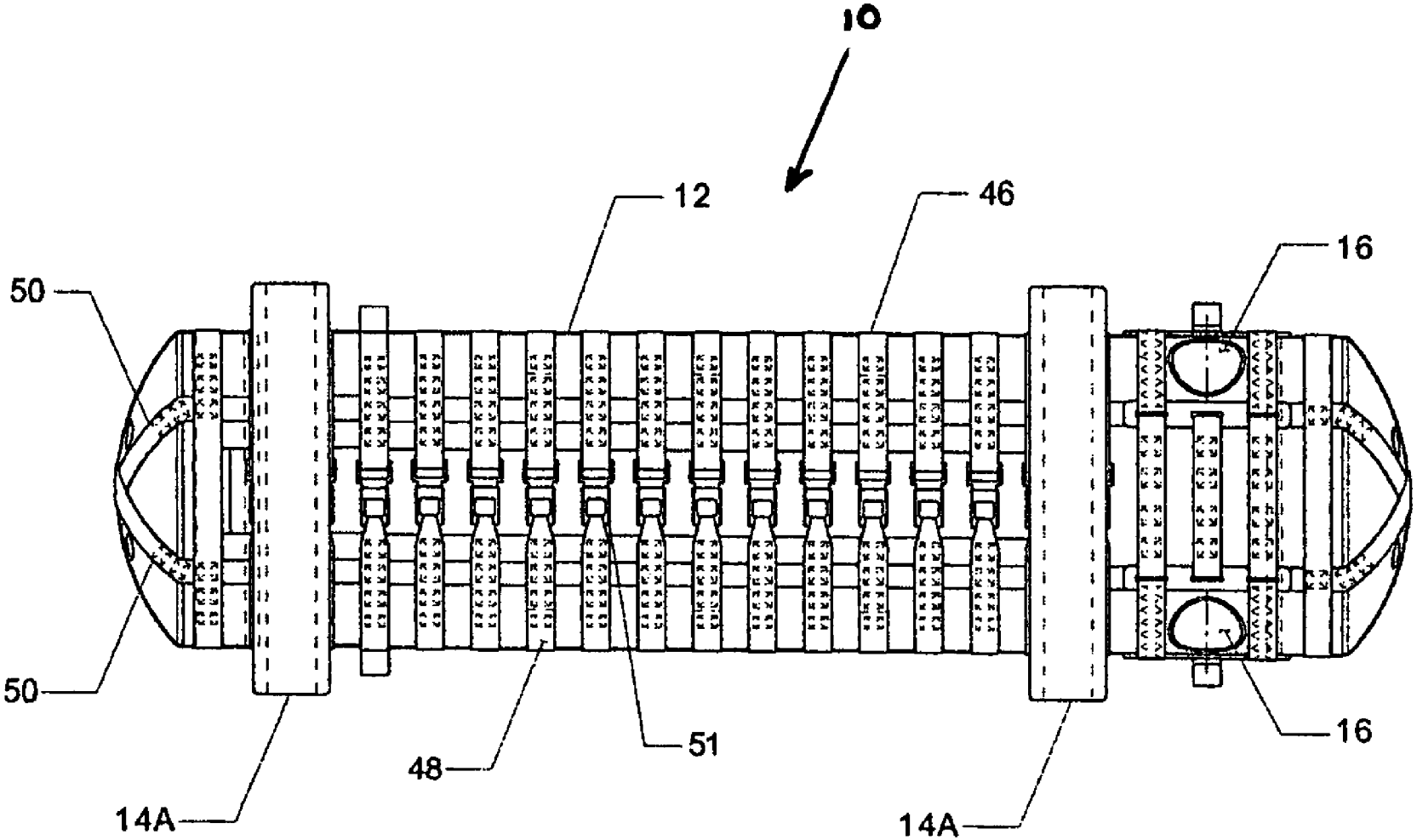
FIG. 2 is a top view of the hyperbaric chamber illustrated in FIG. 1.

An embodiment of the present invention is illustrated in FIGS. 1 and 2. A hyperbaric chamber 10 generally includes a collapsible, and therefore portable, pressurizable bladder 12 and an inflatable support member 14. Bladder 12 can be rendered pressurizable by forming it of an inherently substantially non-breathable material, such as a polyamide, nylon, or polyester. As used herein, the terms "non-breathable" and "air-impermeable" are largely synonymous, and refer to that which is substantially gas-impermeable, at least with respect to the major gaseous components of the atmosphere. Alternatively, bladder 12 may be made of a breathable material treated with a substantially non-breathable polymeric coating such as polyurethane or polyvinylchloride (PVC). Bladder 12 may also include one or more viewports 16, which may be of a flexible film type. In some embodiments of the invention, viewports 16 are polycarbonate-reinforced, for example with a LEXAN® shield 18. Shield 18 prevents deformation and potential failure of viewport 16 under pressure, and thereby facilitates increased pressures within bladder 12.

When pressurized, and thus uncollapsed, bladder 12 is substantially cylindrical in shape. Since bladder 12 is flexible and collapsible, however, it tends to collapse when unpressurized. A collapsed bladder 12 is difficult to enter or exit, and may cause discomfort for a patient occupying an unpressurized, and therefore substantially collapsed, bladder 12 during the initial and final moments of a treatment cycle. To address this, inflatable support member 14 supports bladder 12 in a substantially uncollapsed, substantially cylindrical configuration when depressurized, as shown in FIGS. 1 and 2.

In embodiments, hyperbaric chamber 10 includes multiple inflatable support members 14, for example two external inflatable support members 14*a* and two internal inflatable support members 14*b* located generally at opposing ends of bladder 12 and forming, in effect, a structural frame for bladder 12. It should be understood, however, that more or fewer inflatable support members 14 may be used without departing from the spirit or scope of the present invention. Inflatable support member 14 is, in some embodiments of the invention, an inflatable rib with curvature corresponding generally to the substantially cylindrical shape of the pressurized, uncollapsed bladder 12, though other configurations of inflatable support member 14, such as longitudinal or radial support members, are also contemplated.

Figure 3:
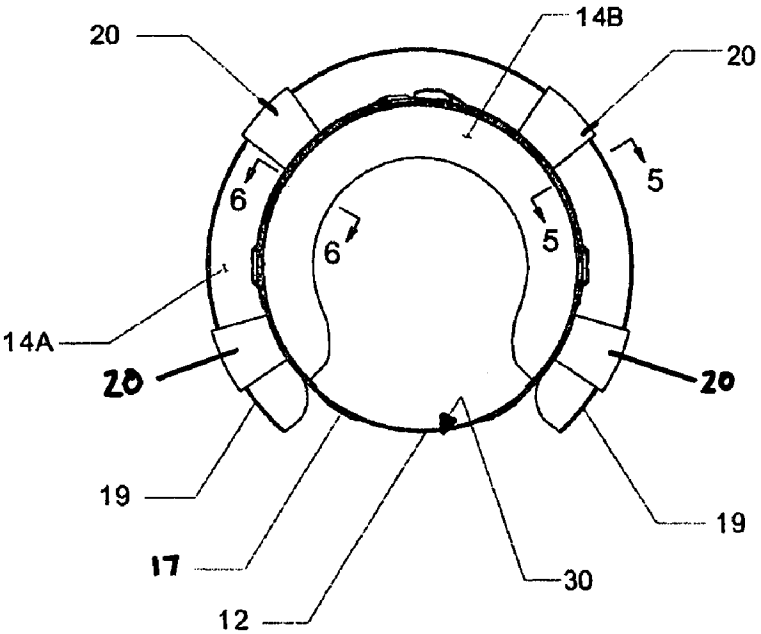
FIG. 3 is a cross-sectional view taken along line 3-3 in FIG. 1.

Referring now to FIG. 3, external inflatable support member 14*a* and internal inflatable support member 14*b* are shown supporting bladder 12 in a substantially uncollapsed, substantially cylindrical configuration. External support member 14*a* externally supports bladder 12 via an attachment to an exterior surface 17 of bladder 12. That is, external support member 14*a* pulls bladder 12 into a substantially uncollapsed configuration. External support member 14*a*, in particular flats 19 thereof, may also serve as a roll-prevention stand for bladder 12.

Figure 4:
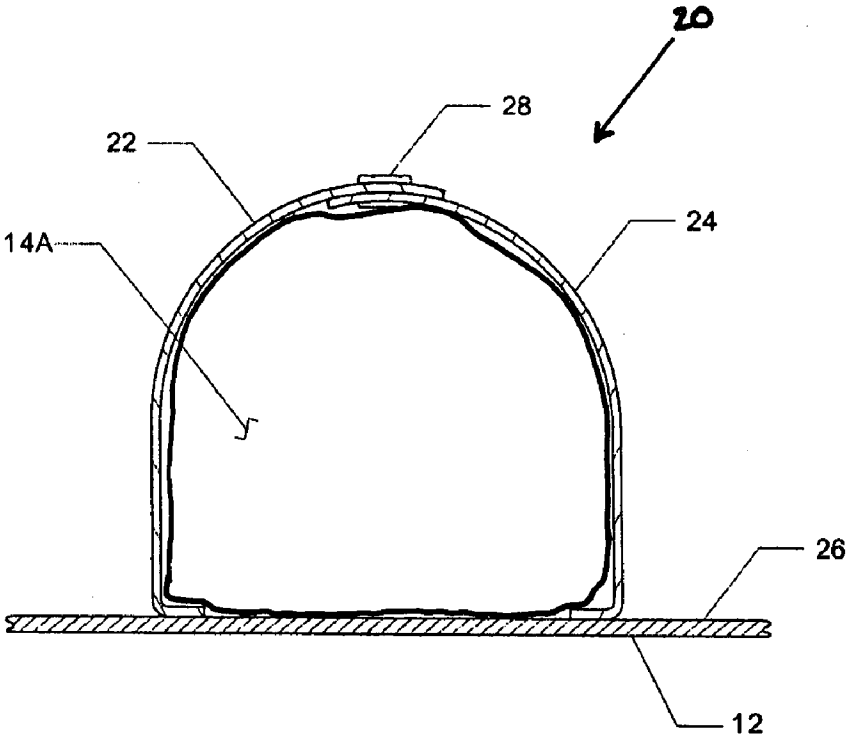
FIG. 4 illustrates a sleeve for attaching an inflatable support member to the bladder in a hyperbaric chamber according to the present invention.

FIG. 4 illustrates an attachment sleeve 20 for attaching external support member 14*a* to bladder 12. Multiple such attachment sleeves 20 may be used to secure external support member 14*a* to bladder 12. Attachment sleeve 20 includes first and second straps 22, 24, which are attached to bladder 12 via an attachment panel 26. First and second straps 22, 24 may alternatively be attached directly to exterior surface 17 of bladder 12. Straps 22, 24, attachment panel 26, and bladder 12 may be attached, for example, via sewing or heat seal. Straps 22, 24 are joined by a fastener, such as a snap, a button, a clasp, a toggle, laces, or a hook-and-loop fastener. In use, external support member 14*a* is placed between straps 22, 24 along exterior surface 17. Straps 22, 24 are then fastened about external support member 14*a*. It should be understood that this assembly may equally be accomplished with external support member 14*a* in an inflated, partially inflated, or completely deflated state. Other methods of attachment, including, but not limited to, permanently attaching external support member 14*a* to bladder 12, such as via sewing or heat seal, are also contemplated.

Returning now to FIG. 3, internal inflatable support member 14*b* supports bladder 12 in a substantially uncollapsed configuration via an abutment against an interior surface 30 of bladder 12. In embodiments, internal support member 14*b* is attached to interior surface 30, for example via a hook-and-loop fastener or a fastener similar to attachment sleeve 20. It should be understood from this disclosure and from practicing the invention, however, that, when inflated, internal support member 14*b* pushes bladder 12 into a substantially uncollapsed configuration regardless of any attachment between internal support member 14*b* and bladder 12. As with external support member 14*a*, the installation of internal support member 14*b* into bladder 12 may be accomplished with internal support member 14*b* in an inflated, partially inflated, or completely deflated state.

Figure 6:
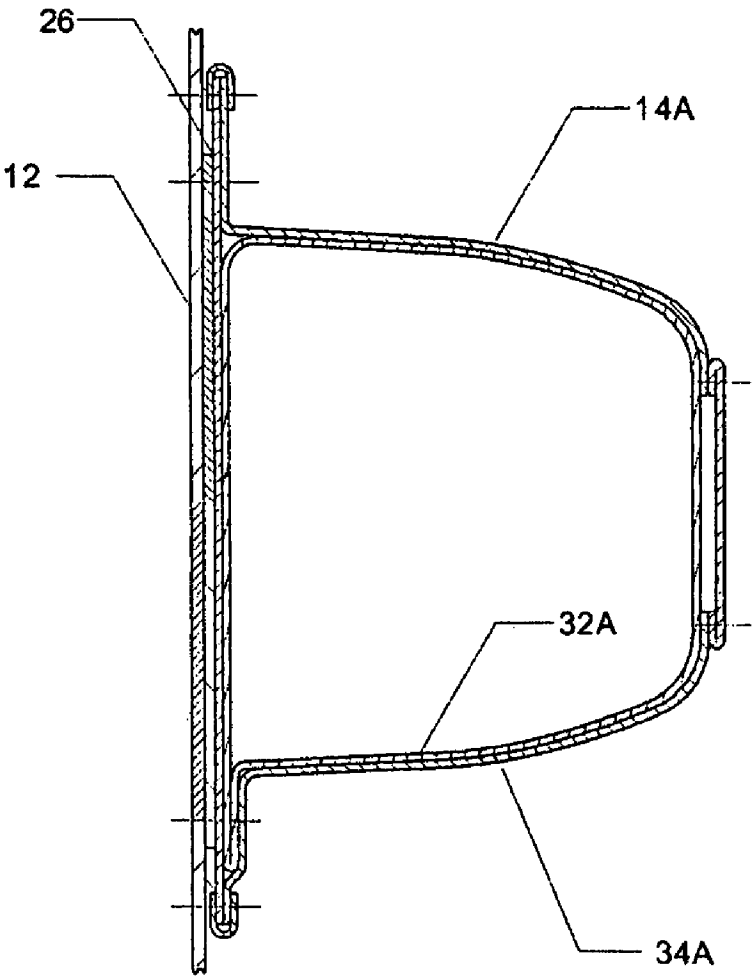
FIG. 6 is a cross-sectional view taken along line 6-6 in FIG. 3.
Figure 5:
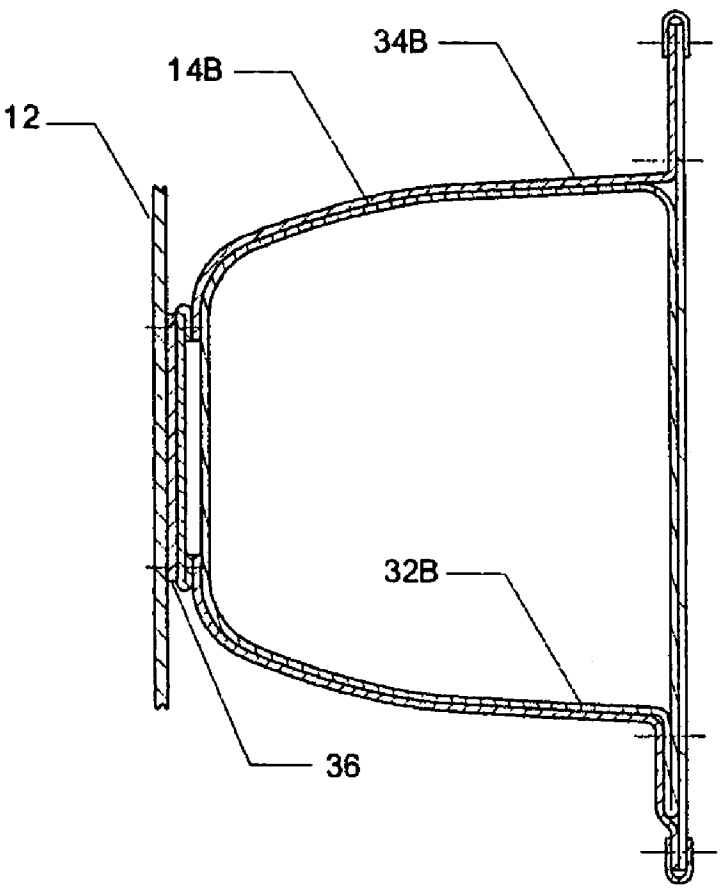
FIG. 5 is a cross-sectional view taken along line 5-5 in FIG. 3.

FIGS. 5 and 6, respectively, show the construction of external and internal support members 14*a*, 14*b*. External and internal support members 14*a*, 14*b* include air bladders 32*a*, 32*b* and jackets 34*a*, 34*b* substantially surrounding air bladders 32*a*, 32*b*. Like bladder 12, air bladders 32*a*, 32*b* may be formed of a substantially non-breathable material, or, alternatively, of a breathable material treated with a substantially non-breathable coating. Jackets 34*a*, 34*b* provide durability and reinforcement to support members 14*a*, 14*b*. Jackets 34*a*, 34*b* further provide a surface for attachment between support members 14*a*, 14*b* and attachment panel 26, in the case of external support member 14*a*, and hook-and-loop fastener 36, in the case of internal support member 14*b*. Jackets 34*a*, 34*b* may be made of polyester or nylon, though other materials are contemplated.

Figure 7:
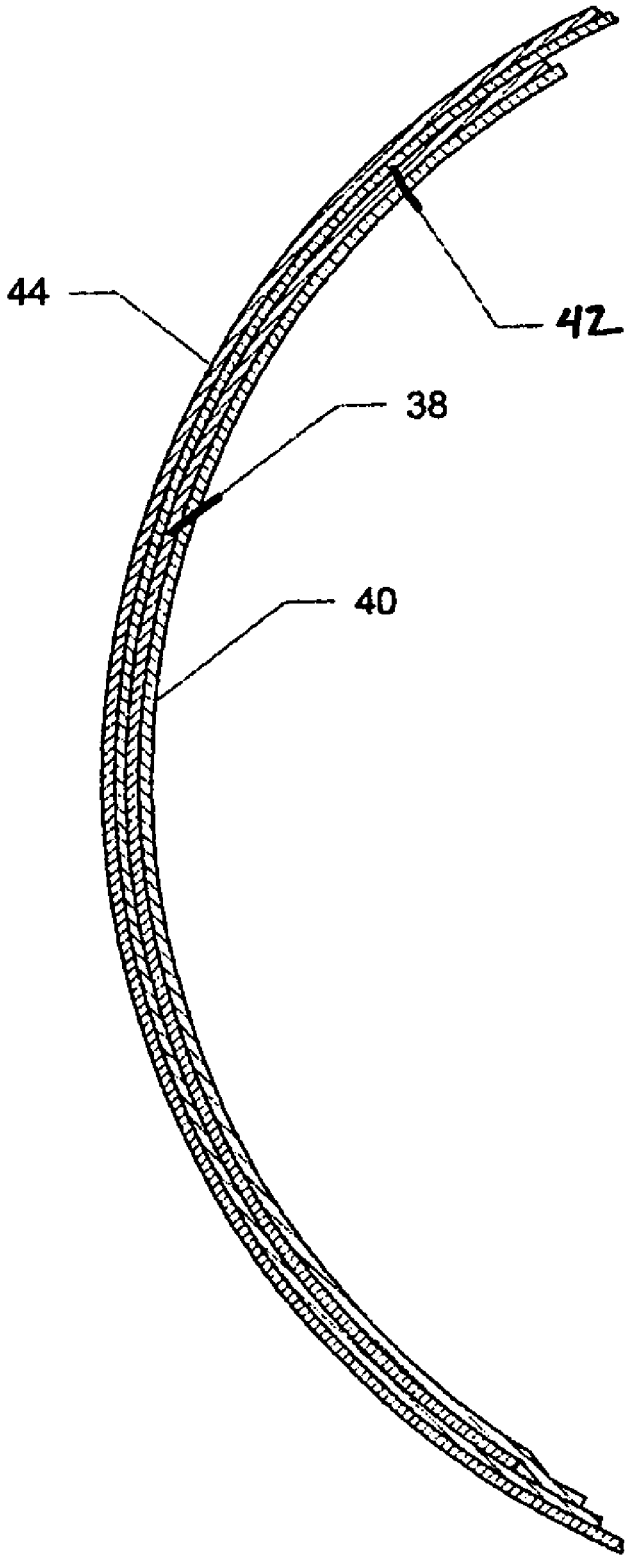
FIG. 7 is a cross-sectional view taken along line 7-7 in FIG. 1.

Returning now to FIG. 1, one or more stiffening staves 38, installed in corresponding stave sleeves 40, may also support bladder 12 in a substantially uncollapsed configuration. Stave 38 and sleeve 40 are also shown in FIG. 7, which further illustrates the construction of bladder 12. Bladder 12 includes a pressurizable internal shell 42 and an outer jacket 44 substantially surrounding shell 42. Internal shell 42 is substantially non-breathable. As with jackets 34 on inflatable support members 14, jacket 44 lends durability and reinforcement to pressurizable internal shell 42, and may be made of polyester or nylon, though other materials are contemplated.

As shown in FIGS. 1 and 2, hyperbaric chamber 10 further includes a reinforcing harness 46 substantially surrounding bladder 12 and disposed on exterior surface 17 thereof. Reinforcing harness 46 increases the pressure achievable within bladder 12. Reinforcing harness 46 may include both circumferential (or hoop) straps 48 and longitudinal straps 50 substantially surrounding bladder 12. Straps 48, 50 may be fastened by buckles 51. In some embodiments of the invention, reinforcing harness 46 includes a plurality of circumferential straps 48 interconnected by at least one longitudinal strap 50 to form a web-like reinforcing harness 46. It should be understood that more or fewer straps 48, 50 than shown may be utilized without departing from the spirit and scope of the present invention, and that the maximum pressure attainable within bladder 12 is related to the number and configuration of straps 48, 50 utilized.

Figure 8:
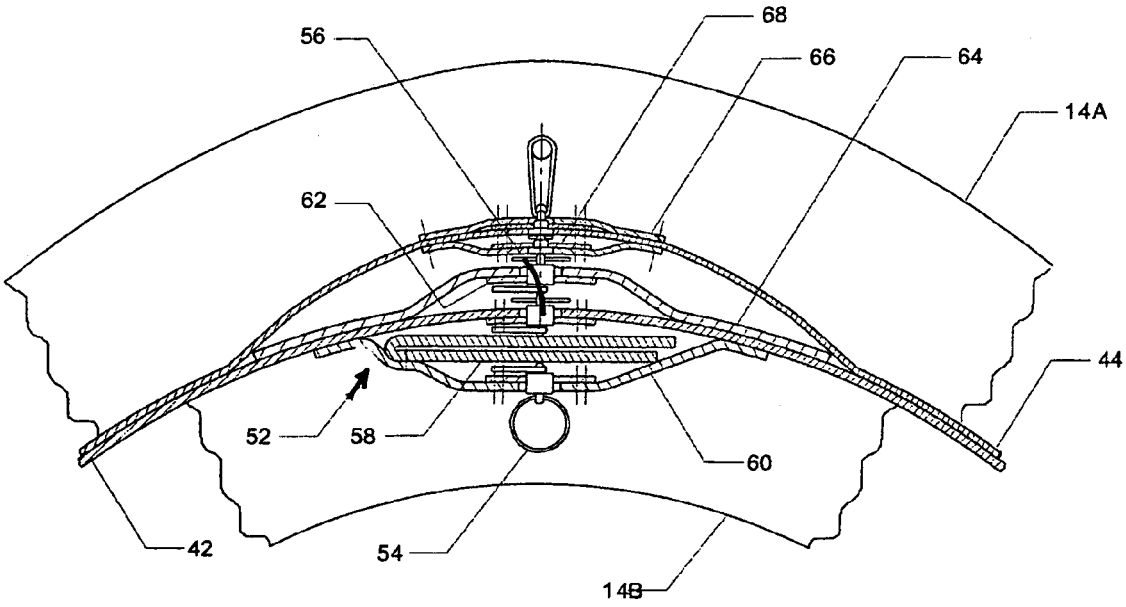
FIG. 8 is a cross-sectional view taken along line 8-8 in FIG. 1.

As shown in FIG. 8, bladder 12 incorporates an accessway to the interior thereof, including a substantially non-breathable closure 52. Non-breathable closure 52 is a multiple zipper closure including a first, inner zipper 54, a second, outer zipper 56, and a substantially air-impermeable gasket 58 disposed between first and second zippers 54, 56. In some embodiments of the invention, first and second zippers 54, 56 extend along substantially the entire length of bladder 12 to facilitate ingress and egress. Gasket 58 is, in some embodiments of the invention, a two-ply rubber flap. As illustrated, first zipper 54 is attached to a first zipper flap 60, while second zipper 56 is attached to internal shell 42. It should be understood, however, that other constructions and arrangements of first and second zippers 54, 56 are contemplated.

To close non-breathable closure 52 and pressurize bladder 12 from the outside of hyperbaric chamber 10, first zipper 54 is closed. Gasket 58 is then laid over first zipper 52, and second zipper 56 is closed. To close non-breathable closure 52 from the inside of hyperbaric chamber 10, the reverse process is followed. Non-breathable closure 52 will seal (that is, gasket 58 will be tightly sandwiched between first and second zippers 54, 56) when bladder 12 is pressurized.

To increase the pressure attainable within bladder 12, non-breathable closure 52 further includes a reinforcing zipper 62 installed in a reinforcing zipper flap 64. Reinforcing zipper 62 also reduces the likelihood of sudden decompression of bladder 12. As illustrated, reinforcing zipper 62 and reinforcing zipper flap 64 are installed outside of second zipper 56. It should be understood, however, that reinforcing zipper 62 and reinforcing zipper flap 64 could equally well be installed inside first zipper 54. Additional zippers 66, 68 may also be incorporated into jacket 44 or internal shell 42 to increase the strength of, and therefore the pressure attainable within, bladder 12.

Figure 9:
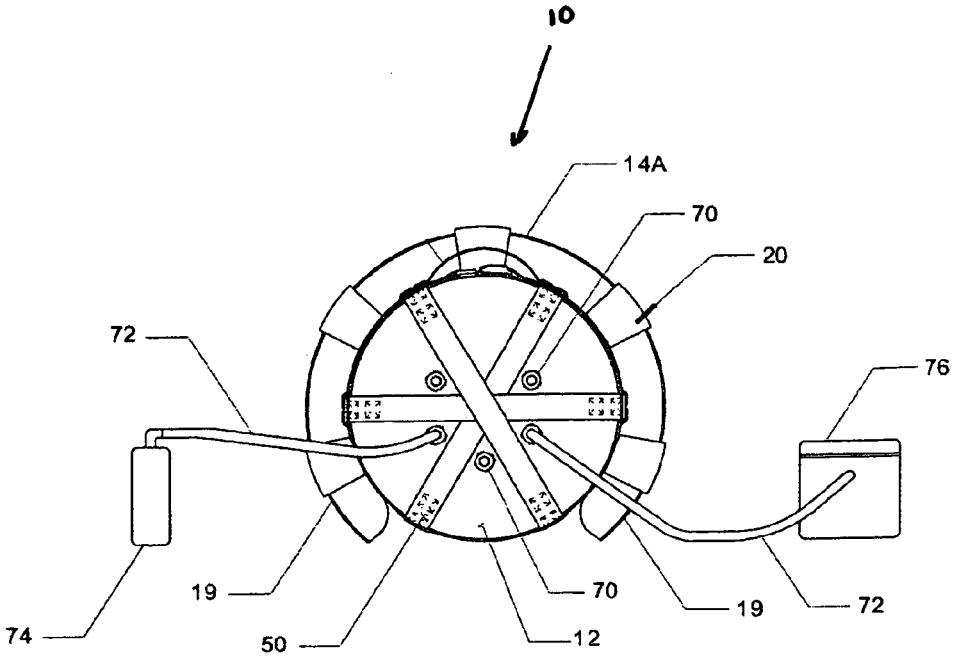
FIG. 9 is an end view of a hyperbaric chamber according to an embodiment of the present invention.

FIG. 9 is an end view of hyperbaric chamber 10. Visible are a number of pass-thrus 70 into the interior of bladder 12. Attached to at least one pass-thru 70 via a hose 72, and thus in fluid communication with the interior of bladder 12, is a source of pressurized air, such as compressed air tank 74. An appropriate valve may be provided adjacent one or both of compressed air tank 74 and pass-thru 70. Compressed air tank 74 may also be used to inflate support members 14.

Attached to a second pass-thru 70 via a second hose 72 is a cooling source 76. Cooling source 76, which, in some embodiments of the invention is a flexible bag filled with ice and water, conditions the air within bladder 12. Cooling source 76 may also be a rigid-walled container, and may further be insulated to preserve the cold contents thereof. Additional elements, for example air scrubbers, rebreathers, oxygen supplies, or chemical/biological decontamination filters, may also be placed in fluid communication with the interior of bladder 12 via additional pass-thrus 70.

Although an example of hyperbaric chamber 10 is shown using zippers 54, 56, 62, 66, and 68, it will be appreciated that other closures can be used. For example, one or more of zippers 54, 56, 62, 66, 68 may be replaced by a hook-and-loop fastener, a series of buttons, snaps, toggles, or clasps, or laces. Further, though pressurized air source has been described and illustrated as a compressed air tank, other sources of compressed air, including, but not limited to, air compressors and pumps, are within the spirit and scope of the present invention. It should also be understood that one or more inflatable support members 14 (e.g., internal inflatable support members 14*b*) may be replaced by a rigid support member. Additionally, though hyperbaric chamber 10 has been described as useful for the treatment of mountain sickness or decompression sickness, it may also be used to isolate and treat an individual who has been exposed to a toxic hazard such as a chemical or biological weapon, and transferred safely under pressure and quarantine as a "hyperbaric stretcher."

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A hyperbaric chamber, comprising:

a collapsible, pressurizable bladder including an accessway into an interior thereof;

a substantially non-breathable closure on said accessway, said closure comprising:

a first zipper;

a second zipper; and a substantially air-impermeable gasket disposed between said first zipper and said second zipper; and a reinforcing zipper disposed on one side of said closure.

2. A hyperbaric chamber, comprising:

a collapsible, pressurizable bladder having an interior and an accessway into said interior, said accessway having a substantially non-breathable closure;

a reinforcing harness substantially surrounding said bladder; and an inflatable support member supporting said bladder in a substantially uncollapsed configuration, wherein the substantially non-breathable closure comprises:

a first zipper;

a second zipper; and a substantially air-impermeable gasket disposed between said first zipper and said second zipper.

3. A system for treating symptoms of pressure sickness, comprising:

a collapsible chamber capable of sustaining hyperbaric pressures, said chamber including an accessway into an interior thereof;

a substantially non-breathable closure on said accessway, said substantially non-breathable closure comprising:

a sealing assembly including a first zipper, a second zipper, and a substantially air-impermeable gasket disposed between said first zipper and said second zipper; and a reinforcing zipper disposed on one side of said sealing assembly;

a reinforcing harness disposed on an outer surface of said chamber, said reinforcing harness comprising a plurality of hoop straps substantially surrounding said chamber and interconnected by at least one longitudinal reinforcing strap substantially surrounding said chamber; and a source of compressed air in fluid communication with said interior of said chamber.

4. The hyperbaric chamber according to claim 2, wherein said reinforcing harness comprises at least one strap substantially circumferentially surrounding said bladder.

5. The hyperbaric chamber according to claim 2, wherein said reinforcing harness comprises at least one strap substantially longitudinally surrounding said bladder.

6. The hyperbaric chamber according to claim 2, wherein said inflatable support member comprises an inflatable rib.

7. The hyperbaric chamber according to claim 6, wherein said inflatable rib externally supports said bladder via an attachment to an exterior surface of said bladder.

8. The hyperbaric chamber according to claim 6, wherein said inflatable rib internally supports said bladder.

9. The hyperbaric chamber according to claim 7, wherein said inflatable rib is attached to an internal surface of said bladder.

10. The hyperbaric chamber according to claim 6, wherein said inflatable rib comprises:

an air bladder; and a jacket substantially surrounding said air bladder.

11. The hyperbaric chamber according to claim 2, wherein said closure further comprises a reinforcing zipper.

12. The hyperbaric chamber according to claim 2, further comprising a cooling source in fluid communication with said interior of said bladder.

13. The hyperbaric chamber according to claim 2, further comprising a source of pressurized air in fluid communication with said interior of said bladder.

14. The hyperbaric chamber according to claim 2, wherein said bladder comprises:

a pressurizable internal shell; and a jacket substantially surrounding said internal shell.

15. The hyperbaric chamber according to claim 2, wherein said bladder further comprises a viewport.

16. The hyperbaric chamber according to claim 15, wherein said viewport is polycarbonate reinforced.

17. The hyperbaric chamber according to claim 2, further comprising a stiffening stave supporting said bladder in said substantially uncollapsed configuration.

* * * * *